US008513580B1

(12) United States Patent
Phillips

(10) Patent No.: US 8,513,580 B1
(45) Date of Patent: Aug. 20, 2013

(54) TARGETING AUGMENTATION FOR SHORT-RANGE MUNITIONS

(75) Inventor: Craig A. Phillips, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/533,064

(22) Filed: Jun. 26, 2012

(51) Int. Cl.
*F42B 15/01* (2006.01)
*F41G 7/00* (2006.01)
*F42B 15/00* (2006.01)

(52) U.S. Cl.
USPC ..... 244/3.21; 244/3.1; 244/3.11; 244/3.13; 244/3.15; 244/3.16

(58) Field of Classification Search
USPC ..... 244/3.1–3.3; 89/1.11; 701/1, 2, 701/3, 4, 8, 9, 16, 17, 23, 50; 382/100, 103; 102/501
See application file for complete search history.

(56) References Cited

U.S. PATENT DOCUMENTS 4,792,904 A * 12/1988 Reinagel et al. ..... 701/17
4,860,968 A * 8/1989 Pinson ..... 244/3.12
4,883,239 A 11/1989 Lachmann et al. ..... 244/3.15
4,898,342 A 2/1990 Kranz et al. ..... 244/3.21
4,964,591 A 10/1990 Wilmot et al. ..... 244/3.16
4,978,221 A * 12/1990 Sepp ..... 244/3.17
5,260,709 A * 11/1993 Nowakowski ..... 244/3.2
5,335,181 A * 8/1994 McGuffin ..... 701/3
5,360,184 A 11/1994 Johnson ..... 244/3.2
5,397,079 A * 3/1995 Strentz et al. ..... 244/3.2
5,762,292 A * 6/1998 Schweyer et al. ..... 244/3.17
5,788,180 A * 8/1998 Sallee et al. ..... 244/3.21
6,260,797 B1 * 7/2001 Palmer ..... 102/501
6,573,486 B1 * 6/2003 Ratkovic et al. ..... 244/3.2
6,711,475 B2 * 3/2004 Murphy ..... 701/3
6,859,729 B2 * 2/2005 Breakfield et al. ..... 701/2
6,892,646 B1 5/2005 Zimmerman et al. ..... 102/293
7,262,394 B2 8/2007 August ..... 244/3.1
7,376,262 B2 * 5/2008 Hu et al. ..... 382/103
7,499,775 B2 * 3/2009 Filippov et al. ..... 701/23
7,675,011 B2 * 3/2010 Jonson ..... 244/3.15
7,791,529 B2 * 9/2010 Filias et al. ..... 701/1
7,920,943 B2 * 4/2011 Campbell et al. ..... 701/9
8,164,037 B2 * 4/2012 Jenkins et al. ..... 244/3.16
8,207,481 B2 * 6/2012 Taylor et al. ..... 244/3.16
8,275,193 B2 * 9/2012 Lin ..... 382/103
8,380,367 B2 * 2/2013 Schultz et al. ..... 701/3
2008/0109141 A1 * 5/2008 Nichols et al. ..... 701/50
2010/0292871 A1 * 11/2010 Schultz et al. ..... 701/3

* cited by examiner

*Primary Examiner* — Bernarr Gregory
(74) *Attorney, Agent, or Firm* — Gerhard W. Thielman, Esq.

(57) ABSTRACT

A method is provided for guiding a mortar projectile fired longitudinally from a launcher along a ballistic trajectory. The method includes providing a first inertial navigation system (INS), a laser emitter and optical sensor on the launcher, providing a second INS and a laser reflector on the projectile, and presetting the second INS to an initial reference position prior to firing the projectile. Subsequent to launch, the method further includes emitting a longitudinally directed laser beam from the emitter to the reflector; receiving the reflected signal to the optical sensor; establishing a position and velocity of the projectile based on the reflected signal; transmitting a correction signal to the projectile from the launcher; resetting the second INS at a position prior to reaching maximum altitude; and guiding the projectile along the trajectory by adjusting control fin orientation.

17 Claims, 4 Drawing Sheets

300

| 310 INS Error Source | 320 1s | 330 Sensitivity | 340 Downrange 1s error (ft) |
|---|---|---|---|
| X Velocity Error (60 deg launch) | 3 fps | 48. per fps | 144 |
| Z Velocity Error (60 deg launch) | 5 fps | 3 per fps | 15 |
| X Position Error (ft) | 3.0 | 1.0 per ft | 3.0 |
| Pitch misalignment (deg) | .06° (1.1 mils) | 82. Per deg | 4.9 |
| Yaw misalignment (mils) | .06° (1.1 mils) | 0.2 per deg | ~0 |
| Roll misalignment (mils) | N/A | 0.0 | 0.0 |
| Yaw drift rate (deg/s) | .02°/s (75°/hr) | 171. per °/s | 3.4 ft |
| Zbody g bias (mgee) | 2 | ~0 (90° terminal dive) | 0.0 |
| Xbody g bias (mgee) | 2 | 1.1 per mgee | 2.2 |

Fig. 3

400

| 410 INS Error Source | 420 1σ | 430 Sensitivity | 440 Downrange 1σ error (ft) |
|---|---|---|---|
| X Velocity Error (60 deg launch) | ~0.1 fps | 48. per fps | 4.8 |
| Z Velocity Error (60 deg launch) | ~0.1 fps | 3 per fps | 0.3 |
| X Position Error (ft) | 3.0 | 1.0 per ft | 3.0 |
| Pitch misalignment (deg) | .03° (0.5 mils) | 82. Per deg | 2.5 |
| Yaw misalignment (mils) | .03° (0.5 mils) | .02 per deg | ~0 |
| Roll misalignment (mils) | N/A | 0.0 | 0.0 |
| Yaw drift rate (deg/s) | .02°/s (75°/hr) | 171. per °/s | 3.4 ft |
| Zbody g bias (mgee) | 2 | ~0 (90° terminal dive) | 0.0 |
| Xbody g bias (mgee) | 2 | 1.1 per mgee | 2.2 |

Fig. 4

530
| Source of Error 510 | Standard Deviation 520 |
|---|---|
| Muzzle Velocity (m/sec) | 2.0 |
| Range Wind (knots) | 4.9 |
| Air Density (%) | 0.5 |
| Air Temperature (%) | 0.5 |
| Form Factor (%) | 1.0 |
| Weapon Location (m) | 1.0 |
| Quadrant Elevation (mils) | 0.5 |
| Jump (mils) | 1.0 |
540
550 560
500
Fig. 5
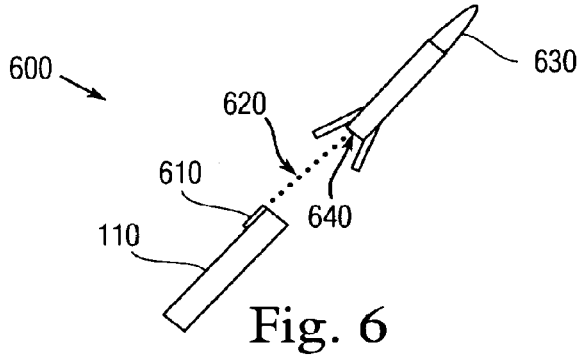
Fig. 6
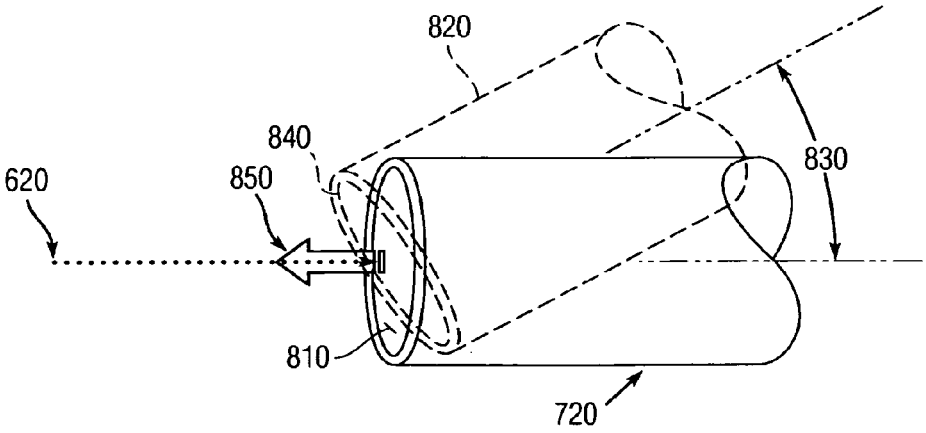
Fig. 8

TARGETING AUGMENTATION FOR SHORT-RANGE MUNITIONS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to improving accuracy in targeting of short-range munitions. In particular, the invention relates to guiding mortar projectiles for improved down-range accuracy.

Presently mortars are unguided which results in large dispersions. Examples have been given in the public literature that two 120 mm mortar system mortars may land more than a kilometer from each other at a range of seven kilometers (7 km). See, e.g., Trohanowsky, R. "120 mm Mortar System Accuracy Analysis", *International Infantry and Joint Services Small Arms Annual Symposium, Exhibition, and Firing Demonstration,* 17 May 2005.

Operations in urban environments require accuracies adequate to enable individual rooms in structures to be targeted. An example might be an enemy sniper operating from a building. The sniper is limited to the use of direct fire and the ability to target the sniper with indirect fire lessens the risk to friendlies and improves unit maneuverability in urban environments.

SUMMARY

Conventional guidance methods yield disadvantages addressed by various exemplary embodiments of the present invention. In particular, unguided short-range ballistic projectiles, such as mortars yield down-range errors that may be unacceptable for some mission scenarios.

Various exemplary embodiments provide a method for guiding a projectile fired longitudinally from a launcher along a ballistic trajectory, including providing a laser emitter and an optical sensor on the launcher directed longitudinally, the emitter transmitting a longitudinally directed laser beam; providing a laser reflector on an aft-facing surface of the projectile to reflect said laser beam as a reflected signal; and guiding the projectile by adjusting control fin position to minimize yaw and pitch moments. These techniques enable a mortar projectile to be guided for improved down-range accuracy to the target.

More particularly, the method provides for guiding a projectile fired longitudinally from a launcher along a ballistic trajectory. The method includes providing a first inertial navigation system (INS), a laser emitter and optical sensor on the launcher, providing a second INS and a laser reflector on the projectile, and presetting the second INS to an initial reference position prior to firing the projectile. Subsequent to launch, the method further includes emitting a longitudinally directed laser beam from the emitter to the reflector; receiving the reflected signal to the optical sensor; establishing a position and velocity of the projectile based on the reflected signal; transmitting a correction signal to the projectile from the launcher; resetting the second INS at a position prior to reaching maximum altitude; and guiding the projectile along the trajectory by adjusting control fin orientation.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 3 is a tabular view of projectile inertial navigation system error sources contributing to target inaccuracy for a baseline system;

FIG. 4 is a tabular view of inertial error sources as corrected in accordance with exemplary embodiments;

FIG. 5 is a tabular view of comparative error source contributions to a miss distance of the mortar projectile;

FIG. 6 is an elevation schematic of a mortar projectile and launcher guidance system;

FIG. 8 is an isometric view of change in reflection angle of a laser reflector mounted on the aft surface of the projectile in relation to the projectile's yaw and pitch orientation.

DETAILED DESCRIPTION

Figure 1:
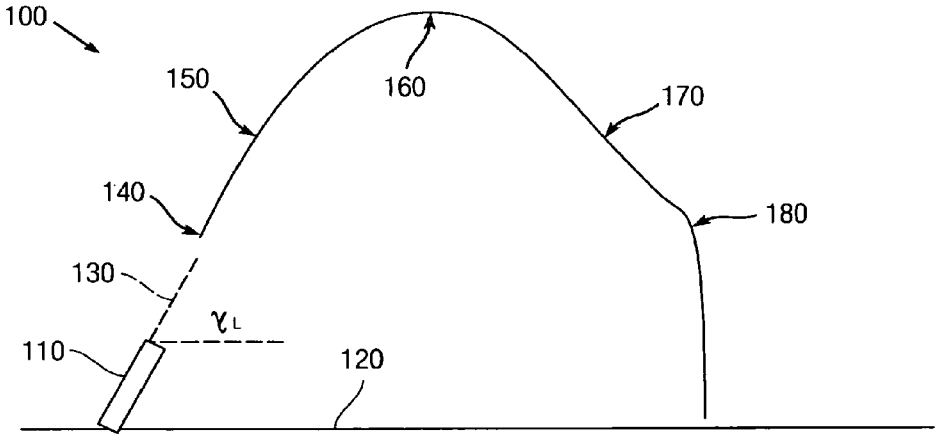
FIG. 1 is an elevation schematic view of a ballistic-like trajectory of a mortar projectile.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide a method to improve the accuracy of short range munitions such as mortars to allow use in urban environments. The acceleration of gun or mortar launch causes an inertial navigation system (INS) to saturate during the launch and a continuous navigation solution is not available from a pre-launch initialization. After launch, the INS solution no longer maintains validity.

The issue of increased accuracy has been addressed for longer range munitions by the addition of Global Positioning System (GPS) satellites and micro-electromechanical systems (MEMS) based INS. For guided missiles, its INS is typically initialized by the INS of the carrier vehicle prior to launch and the missile's INS is able to track motion throughout the flight for an accurate navigation solution.

Longer range munitions have sufficient time to acquire a GPS signal and use this to recalibrate their INS. The calibration of the attitude angles of the INS solution requires 10-to-30 seconds (10-30 sec) beyond the initial acquisition of the GPS signal. For mortars this timeline is unacceptable because the maximum time-of-flight is typically less than 40 seconds at maximum range.

Beyond the short timeline issue associated with the necessity to recalibrate the INS by GPS, another issue associated with mortar operations renders GPS calibration of the INS problematic: in particular the relative altitude of the mortar trajectory as compared to artillery launched munitions, such as the 155 mm M1 Long Tom field gun with about an order of magnitude longer range than the 60 mm M2 smoothbore mortar, both used in the Second World War.

At high altitudes, avoidance of ground based jamming can be readily accomplished by the use of body shielding and GPS antenna gain pattern shaping to reject any signals from the ground. But at low altitudes associated with mortar trajectories, the line of sight angles from GPS jammers located on tall buildings to the vehicles places the jammers close to the horizon angle for the vehicle. Thus, building an antenna system to reject GPS jammers for the mortar in the urban environment can be difficult.

The GPS calibration of the INS for mortars presents a number of problems that render that technique untenable for adjusting trajectory to minimize target error. Conventionally, an alternative is to use an INS-only system. In this approach, the INS is reset to a pre-launch value after exit from the tube based on the desired range to the target (which sets the charges used) and the barrel angle. Gun-launch-survivable INS designs using MEMS have made great strides in the past decade to reduce drift rates and bias errors that often drive free inertial navigation errors. A free inertial system can correct for the errors associated with metrological unknowns that increase the dispersions of unguided round. However, the absence of feedback restricts ability to improve accuracy from other factors.

FIG. 1 shows a generic ballistic mortar trajectory in an elevation schematic view 100 in accordance with the various exemplary embodiments. A mortar launcher 110 is oriented at launch angle $\gamma_L$ from the horizontal plane 120 to point upward along a lookout direction 130. In various exemplary embodiments, a laser-based sensor is mounted in a precisely known alignment on the mortar launcher. The launcher 110 fires a projectile along a flight path shown beginning at the INS reset position 140, continuing upward towards ballistic freefall 150, reaching peak altitude 160 after which active guidance initiates 170, and maneuvering 180 to turn down for vertical interception towards the target.

Figure 2:
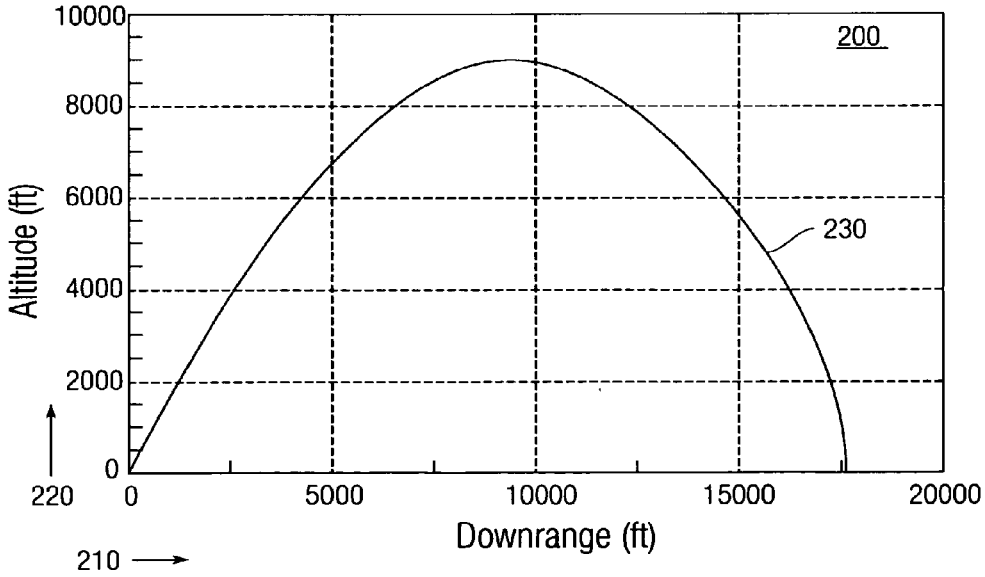
FIG. 2 is a plot of altitude and range of the ballistic-like trajectory.

FIG. 2 shows a ballistic plot 200 of range as the abscissa 210 and altitude as the ordinate 220. An approximately ballistic trajectory 230 is shown beginning at launch and proceeding to a maximum altitude of about nine-thousand feet at about nine-thousand feet downrange, and falling to the ground
at about seventeen-thousand feet downrange.

FIG. 3 provides a tabular list 300 for Dispersion Budget for Current Systems for conventional systems. The columns include INS error source 310, Standard Deviation 320, Sensitivity 330, Downrange Error (feet) 340 for one-sigma standard deviation. The sources include range and altitude errors, angle misalignment, and gravity bias. The velocity errors in the longitudinal and vertical directions dominate for these ballistic trajectories.

Because setting the velocity of the round must be based on pre-launch estimates, the dispersions are dominated by the uncertainty in the performance of the launch charges and the resulting velocity of the mortar. The tabular list 300 in FIG. 3 includes a set of dispersions associated with a generic mortar system. The velocity errors are obtained from Trohanowsky. The remainder of the variations is taken either from Trohanowsky or from LeFevre, V. C., et al., "MEMS IMU—Common Guidance", 40$^{th}$ *Annual Armaments Conference NDIA,* 28 Apr. 2005.

As can be observed, the majority of the miss distance is caused by the uncertainty in the achieved velocity of the round due to the round-to-round variation of charges. Current propellant technology limits the minimization of the round-to-round one-standard-deviation variation to about two meters per second (2 m/s) from Trohanowsky. The exemplary method embodiments provide a direct measurement of the achieved speed at the exit from the barrel that is used to calibrate the INS after launch and to reduce the errors.

Root-Mean-Square (RSS) Analysis of Miss: As review, upon identification of all the major sources of error, the overall effect can be evaluated statistically by taking the RSS of all the Component Errors:

$$\sigma=\sqrt{\Sigma_i(u_i\times\sigma_i)^2},$$

where σ, called "sigma", represents the standard deviation of the system characteristic of being evaluated and u represents sensitivity.

Sigma can represent precision error, the bias error or a combination of both. In this example, σ (sans subscript) represents the total system error in range. For components i, error $\sigma_i$ represents the standard deviation of each individual source of error. For example, test data may show that the muzzle velocity for a given lot of ammunition has a standard deviation of 2.5 m/sec, in which case velocity error $\sigma_{MV}$=2.5 m/sec.

The parameter $u_i$ represents sensitivity of σ to $\sigma_1$. This sensitivity value represents how much σ is affected by a unit change in $\sigma_i$. For example, if a variation of 1 m/sec in muzzle velocity can affect range by 14.4 m, then sensitivity $u_{MV}$=14.4 m/(m/sec). These values are also referred to as a unit effects or partial effects. The cross product of $u_i\times\sigma_i$ represents the component error, or the effect that each individual source of error has on the total system error.

FIG. 4 provides a tabular list 400 for Dispersion Budget for Current Systems under various exemplary embodiments. The columns include INS error source 410, Standard Deviation 420, Sensitivity 430, Downrange Error (feet) 440 for one-sigma standard deviation. The sources include range and altitude errors, angle misalignment, and gravity bias. The corrected velocity errors reduce by an order of magnitude as compared to the baseline method of provided in tabular list 300. Longitudinal (X) and altitude (Z) velocities reduce respectively from three and five feet-per-seconds both to about a tenth feet-per-second. Pitch and yaw misalignment reduce by about half from 0.06° to 0.03°.

A comparison of error sources can be shown to identify source contributions for reduction. FIG. 5 as a tabular list 500 with an error source 510 in the left column and standard deviation 520 in the right column. In particular, the list of source contributions, including muzzle velocity 530, environmental conditions 540 and orientation 550. A list of standard deviations 560 shows the relative differences in spread that produce inaccuracies in aim. The largest contributors include muzzle velocity and range wind.

Figure 7:
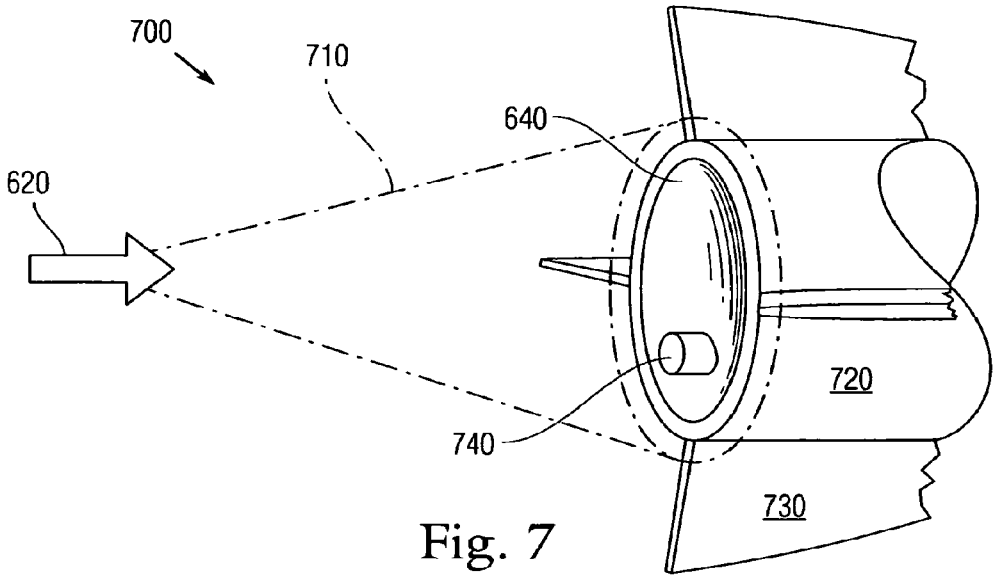
FIG. 7 is an isometric view of an aft portion of the mortar projectile.

Various exemplary embodiments provide for resetting the INS after launch by the use of ground position, velocity, and attitude measured directly after launch instead of pre-set values. FIG. 6 shows an equipment configuration 600 featuring a laser emitter 610 equipped with an optical sensor and mounted in a precisely known alignment on the mortar launcher 110. The laser emitter 610 transmits a coherent photon beam 620 (continuous or pulse) to the mortar round or projectile 630. The beam 620 is directed at a retro-reflector 640 on the projectile 630. FIG. 7 shows a detail view 700 of the projectile 630. In particular, the beam 620 illuminates a conical zone 710 that aims at the retro-reflector 640 mounted at the projectile's aft end 720 that may be equipped with aerodynamic fins 730 for flight stability and control. The reflector 640 further includes a laser receiver 740 for receiving course correction signal commands from the launcher 110 to relay to the guidance instruments on the projectile 630.

FIG. 8 illustrates how the body attitude changes the reflected magnitude, enabling correlation of received reflected signal with projectile pitch and yaw orientation relative to the launcher 110. For example, the projectile aft section 720 in solid line with an aft reflector 810 (i.e., the reflector 640) can pitch to a tilted orientation on aft end 820 by an angle 830. The tilted end 820 includes a corresponding tilted aft reflector 840, both shown in dash line. A laser pulse, exemplified by the beam 620 from the emitter 610 on the launcher 110, strikes the retro-reflector 640. The reflector 640 sends a reflection signal 850 from the reflector, whether in orientation as 810 or as 840 that returns to the launcher 110. The reflection signal 850 has a reflection efficiency that varies monotonically with the angle 830 between the arrival path of the beam 620 and the centerline of the reflector 640. In response to diminution of the received signal 850 from the reflector 640 prior to reaching peak altitude, a course correction signal can be transmitted to the laser receiver 740 to reset the ground position, altitude and velocity states on the second INS on the projectile 630. This enables the projectile 630 to be maintained along a corrected trajectory towards the target despite the brief flight interval.

A launcher receiver associated with the emitter 610 receives the reflection signal 850 from the reflector 640. The ground position, velocity and attitude of the launcher 110 (either stationary or mounted to a mobile platform) can be measured accurately and combined with the laser measurement to obtain the ground position, velocity and attitude of the projectile 630. After obtaining measurements of the projectile's position, velocity and attitude based on the reflected signal 850, course corrections are transmitted by an encoded laser signal to the laser receiver 740 on the projectile 630 to reset the INS.

This resetting instrument consists of the laser emitter 610 that sends a short pulse beam 620 to the retro-reflector 640 located on the projectile aft end 720 within a millisecond after the projectile 630 exists from the launcher 110. At this stage of the trajectory 230, the projectile 630 can be directly ahead of the laser emitter 610. The reflector 640 returns the reflection signal 850 to the origin of the initial laser pulse beam 620, which is received by a launch sensor coexisting with the emitter 610. Then the instrument of the various exemplary embodiments uses a process such as phase detection or an interferometer to measure the distance between the launcher 110 and the projectile 630. The velocity of the projectile 630 can then be determined by differencing the position of the projectile 630 from at least two very short and rapid pulses or by a direct measurement of the Doppler frequency shift of the reflected light. Such short pulses can be separated by intervals of less than a millisecond.

Figure 9:
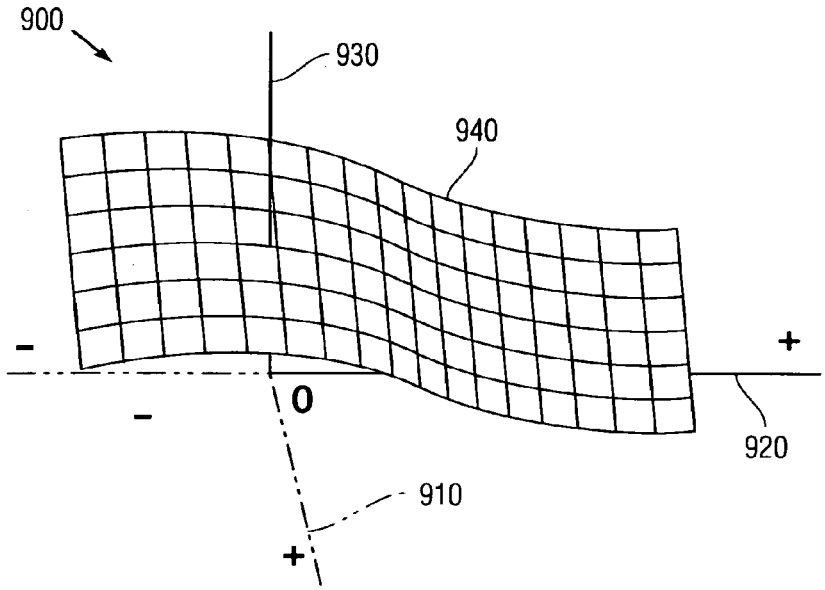
FIG. 9 is an isometric graphical view of an efficiency map of the projectile's reflections in relation to its yaw and pitch angles.

FIG. 9 presents an orientation concept as a three-dimensional plot map 900 for varying the reflection magnitude in pitch and yaw angle. The axes for pitch 910, roll 920 and yaw 930 are orthogonal to each other. The vertical axis 930 is the reflection efficiency of the retro-reflecting reflector 640 in terms of the orientation angle 830 of the projectile 630. A curvilinear plane 940 shows a trajectory space in which to maneuver the projectile 630 relative to the launcher 110. Because the reflector efficiency is monotonic in both pitch 910 and yaw 930, and because the time-of-flight of the laser beam 620 determines the distance from the launcher 110 to the projectile 630, the known value of the emitted laser beam's signal strength and the magnitude of the reflected return signal 850 enables a unique determination of the pitch and yaw angles to be determined, assuming that the roll angle is known. This obviates barrel rifling of the launcher 110 because the projectile 630 is guided. Hence, the launcher 110 is designed to minimize the induced roll, with roll angle assumed to remain constant as the known launch value, the update time being only milliseconds after launch.

Various exemplary embodiments provide a method in which the pitch and yaw angle attitude of the projectile 630 can also be measured. The reflection efficiency of the retro-reflector 640 is designed to be monotonically dependent on the pitch and yaw angle combination at which the laser beam 620 arrives at the retro-reflector 640. The magnitude of the reflected return signal 850 may then be used to determine the attitude of the projectile 630 in terms of the pitch and yaw angle using computational processing. Within a required resolution grid, each pitch and yaw angle combination has a unique reflection efficiency. Knowledge of the emitter's signal strength, the distance of the projectile 630 from the launcher 110 (as measured by the launcher's receiver) based on the return signal 850, the retro-reflector map 940 enables the pitch and yaw angles to be determined based on the roll angle of the projectile 630.

As a summary of the process, various exemplary embodiments include the following operations. A method provides for guiding a projectile fired longitudinally from a launcher along a ballistic trajectory, and includes providing, prior to launch, a first inertial navigation system (INS), a laser emitter and optical sensor on the launcher, providing a second INS and a laser reflector on the projectile, and presetting the second INS to an initial reference position prior to firing the projectile. Subsequent to launch, the method further includes emitting a longitudinally directed laser beam from the emitter to the reflector less than one millisecond subsequent to firing the projectile; receiving the reflected signal to the optical sensor on the launcher; determining a ground position, altitude and velocity of the projectile based on the reflected signal; transmitting a correction signal (including the measured projectile's position, altitude and velocity relative to the launcher, as well as the time of measurement) to the projectile from the launcher; resetting position, altitude and velocity for the second INS at a position prior to reaching maximum altitude based on extrapolation from the correction signal; and guiding the projectile by orientation adjustment of the control fins 730.

The advantages of the exemplary system include increased accuracy and lethality of indirect short range munitions while maintaining a relatively low cost mortar design. The new feature is the resetting of the INS of the guided mortar by the direct measurement of the mortar position, velocity, and attitude by a simple laser device attached to the mortar launcher. The linking of this information to the mortar round in-flight by an encoded laser beam to a receiver on the mortar round and resetting the ground position, altitude and velocity states of the second INS on the projectile constitute new features.

Alternatives to these exemplary methods include the use of very fast acquisition GPS receivers that can reject jamming signals near the vehicle horizon angle. If such receivers could be built to survive launch accelerations, these would increase the cost of size of the round and make pre-launch operations more complex because of the need to load the GPS ephemeris into the round before launch. Thus, these alternatives provide disadvantages that are mitigated by various exemplary embodiments disclosed herein.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A method for guiding along a ballistic trajectory a mortar projectile fired longitudinally towards a target from a launcher through a muzzle, said launcher equipped with an inertial navigation system (INS), said method comprising:

providing a mortar INS for the projectile loaded in the launcher synchronized with the INS;

providing a laser emitter and an optical sensor on the launcher directed longitudinally towards the muzzle;

providing a laser reflector on an aft-facing surface of the projectile;

presetting said mortar INS to an initial reference ground position prior to firing the projectile;

emitting a longitudinally directed laser beam from said emitter to said reflector less than one millisecond subsequent to firing the projectile, said reflector reflecting said beam as a reflected signal;

receiving said reflected signal to said optical sensor;

determining a first in-flight state of ground position, altitude and velocity of the projectile by the INS on the launcher based on said reflected signal;

transmitting a correction signal from the launcher to a receiver on the projectile, said correction signal providing said first in-flight state relative to the launcher;

resetting said mortar INS at a second in-flight state, extrapolated from said first in-flight state, prior to reaching maximum altitude based on said correction signal; and guiding the projectile to adjust its control fin orientation to thereby engage the target.

2. The method according to claim 1, wherein said reflector exhibits a reflection efficiency that varies monotonically with an angle between said beam and a centerline of said reflector.

3. The method according to claim 1, wherein said second in-flight state includes ground position, altitude and velocity.

4. The method according to claim 1, wherein said emitter fires said beam in a series of pulses.

5. The method according to claim 1, wherein adjusting orientation of said fins minimizes yaw and pitch moments of the projectile.

6. The method according to claim 1, wherein said guiding operation further includes adjusting control fin position of the projectile to maximize amplitude of said reflected signal.

7. The method according to claim 6, wherein said control fin position of the projectile is set to maximize amplitude of said reflected signal.

8. The method according to claim 1, wherein said guiding operation further includes:

measuring a first distance between the launcher and the projectile, measuring a second distance between the launcher and the projectile at a time interval of less than one millisecond from said first distance, and determining a velocity of the projectile by differencing said first and second distances.

9. The method according to claim 1, wherein said guiding operation further includes:

determining a first frequency of said reflected signal at a first time, determining a second frequency of said reflected signal at a second time at a time interval of less than one millisecond from said first frequency, and determining a velocity of the projectile by determining a Doppler shift of said reflected signal.

10. The method according to claim 1, wherein said transmitting said correction signal includes position of the mortar and time of measurement.

11. A system for guiding a projectile fired longitudinally from a launcher along a ballistic trajectory towards a target, said projectile having control surfaces, said system comprising:

a first inertial navigation system (INS) for the launcher;

a second INS for the projectile loaded in the launcher, said second INS being set to an initial reference position prior to being fired from the projectile and synchronized with said first INS;

a laser emitter with an optical sensor on the launcher directed longitudinally, such that said emitter emits a longitudinally directed laser beam to said reflector less than one millisecond subsequent to firing the projectile;

a laser reflector on an aft-facing surface of the projectile to reflect said laser beam as a reflected signal to said optical sensor; and a signal transmitter on said launcher for sending a correction signal to a receiver on the projectile, said correction signal providing an in-flight state of ground position, altitude and velocity of the projectile based on said reflected signal, wherein said optical sensor receives said reflected signal, said first INS establishes a position and velocity of the projectile based on said reflected signal, said second INS resets a position of said projectile prior to reaching maximum altitude based on said correction signal; and the control surfaces adjust orientations responsive to said second INS for adjusting the trajectory of the projectile to engage the target.

12. The system according to claim 11, wherein said correction signal includes ground position, altitude, and velocity of the projectile and time of measurement.

13. The system according to claim 11, wherein said reflector exhibits a reflection efficiency that varies monotonically with an angle between said beam and a centerline of said reflector.

14. The system according to claim 11, wherein said second in-flight state includes ground position, altitude and velocity.

15. The system according to claim 11, wherein said emitter fires said beam in a series of pulses.

16. The system according to claim 11, wherein said control surfaces of the projectile are oriented to minimize yaw and pitch moments of the projectile.

17. The system according to claim 11, wherein said control surfaces of the projectile are oriented to maximize amplitude of said reflected signal.

* * * * *